US008684511B2

(12) United States Patent
Lahut et al.

(10) Patent No.: US 8,684,511 B2
(45) Date of Patent: Apr. 1, 2014

(54) INK JET UV PINNING FOR CONTROL OF GLOSS

(75) Inventors: Joseph A. Lahut, Moultonboro, NH (US); Dwight Cram, Concord, NH (US); John Duffield, Meredith, NH (US); Peter Heath, Alexandria, NH (US)

(73) Assignee: Electronics for Imaging, Inc., Foster City, CA (US)

( * ) Notice: Subject to any disclaimer, the term of this patent is extended or adjusted under 35 U.S.C. 154(b) by 266 days.

(21) Appl. No.: 13/218,233

(22) Filed: Aug. 25, 2011

(65) Prior Publication Data

US 2013/0050368 A1 Feb. 28, 2013

(51) Int. Cl.
*B41J 2/01* (2006.01)

(52) U.S. Cl.
USPC ..... 347/102

(58) Field of Classification Search
None
See application file for complete search history.

(56) References Cited

U.S. PATENT DOCUMENTS

| | | | | |
|---|---|---|---|---|
| 6,145,979 | A | 11/2000 | Caiger et al. | |
| 6,457,823 | B1 | 10/2002 | Cleary | |
| 6,595,612 | B1 | 7/2003 | Brown et al. | |
| 6,739,716 | B2 | 5/2004 | Richards | |
| 6,789,867 | B2 | 9/2004 | Takahashi et al. | |
| 7,152,969 | B2 | 12/2006 | Hintermann | |
| 7,152,970 | B2 | 12/2006 | Hasebe et al. | |
| 7,600,867 | B2 * | 10/2009 | Mills et al. | 347/102 |
| 7,837,319 | B2 | 11/2010 | Rodin et al. | |
| 8,201,909 | B2 | 6/2012 | Barbour et al. | |
| 2002/0024558 | A1 | 2/2002 | Fujita et al. | |
| 2003/0103100 | A1 | 6/2003 | Vanhooydonck et al. | |
| 2010/0013878 | A1 | 1/2010 | Spaulding et al. | |
| 2010/0289852 | A1 | 11/2010 | Woolfe et al. | |
| 2010/0289860 | A1 | 11/2010 | Takezawa et al. | |
| 2011/0069128 | A1 * | 3/2011 | Onishi | 347/102 |

FOREIGN PATENT DOCUMENTS

| | | |
|---|---|---|
| EP | 471488 | 2/1992 |
| EP | 0518670 | 12/1992 |
| EP | 0665114 | 8/1995 |

* cited by examiner

*Primary Examiner* — Stephen Meier
*Assistant Examiner* — Tracey McMillion
(74) *Attorney, Agent, or Firm* — Michael A. Glenn; Perkins Coie LLP

(57) ABSTRACT

Gloss is controlled in UV ink jet printing within a printing system. Controlled pinning energy is used to adjust the amount of ink interaction between drops, substrate, and ink layers, resulting in virtual elimination of gloss banding and control of the finished gloss level from a gloss level of approximately 85 to a gloss level of approximately 5.

24 Claims, 9 Drawing Sheets

INK JET UV PINNING FOR CONTROL OF GLOSS

BACKGROUND OF THE INVENTION

1. Technical Field

The invention relates to inkjet printing. More particularly, the invention relates to ink jet UV pinning for control of gloss.

2. Description of the Background Art

Certain types of printing systems are adapted for printing images on large-scale substrates, such as for museum displays, billboards, sails, bus boards, and banners. Some of these systems use so-called drop on demand ink jet printing. In these systems, a carriage which holds a set of print heads scans across the width of the substrate while the print heads deposit ink as the substrate moves.

Solvent based inks are sometimes used in these systems in which an infrared dryer is used to dry off the solvent after the ink is deposited onto the substrate. Systems using solvent based inks are able to print on flexible substrates such as PVC materials and reinforced vinyl. However, solvent based inks are typically considered to be unusable for printing on rigid substrates such as metals, glass, and plastics. Therefore, to print on rigid, as well as flexible substrates, radiation-curable inks such as UV-curable inks are often preferred. For these systems, the ink is deposited onto the substrate and then cured in a post-printing stage. For instance, after the deposition of the ink, the substrate moves to a curing station. The ink is then cured, for example, by exposing it to UV radiation. In other systems, the UV radiation source for curing is mounted directly on the same carriage that carries the set of print heads.

UV ink jet dot gain is a parameter that is difficult to control. Ink deposited onto a substrate, until it is cured with UV energy, can react by spreading or shrinking depending on the surface tension and surface energy of the ink and substrate. Drop to drop interactions also complicate the control of dot gain and gloss. The time frames of interaction are such that locations of various colors and print heads with respect to the cure lamp result in differential gloss banding, an objectionable printing artifact.

Methods to correct this time-to-lamp problem have been proposed and implemented. For example, Ink Jet Printer with Apparatus for Curing Ink and Method (U.S. Pat. No. 6,145,979) describes a method to prolong, uniformly, the time-to-lamp for an ink jet printer through the use of mirrors or a post cure lamp traveling with the print carriage.

Image Forming Apparatus Having a Plurality of Printing Heads (U.S. Pat. No. 7,152,970) describes a method of positioning UV cure lamps adjacent to each print head color to equalize the time to lamp between print heads and colors.

Digital Ink Jet Printing Method and Apparatus and Curing Radiation Application Method (U.S. Pat. No. 7,837,319) describes a method of applying a first and second intensity UV cure energy, each applied at a constant time for all locations on the substrate.

Another method used to mitigate differential gloss banding is to use pinning (aka setting), the application of a low UV energy (the order of 5% of cure energy) to freeze or gel the ink dots on the media as soon as possible after application to the media, where they are later cured by high intensity UV radiation. Examples of this method are disclosed in Systems and Methods for Curing a Fluid (U.S. Pat. No. 6,739,716), which describes two UV cure lamps or reflectors that direct two different power levels onto a substrate as ink jet ink is applied. The result is to freeze each layer of ink that is applied so as to prohibit interaction between the ink layers.

Method of Printing Using Partial Curing by UV Light (U.S. Pat. No. 7,152,969) similarly describes pinning to allow many passes of ink application without drop to drop interaction.

The assignee of the present application, EFI, holds two patents in this area: Apparatus and Method for Setting Radiation Curable Ink (U.S. Pat. No. 6,457,823) and Radiation Treatment for Ink Jet Fluids (U.S. Pat. No. 7,600,867), both of which are aimed at inhibiting ink to ink or ink to substrate interactions.

Methods of controlling ink interactions to minimize gloss banding print artifacts by time-to-lamp or pinning and curing can still result in print artifacts due to other variables. Short times to lamp or pinning result in low dot gain with thick ink build up and loss of color due to small dot size. Gloss banding continues to persist due to bidirectional laydown of droplets, which result in physical reflectance which is directionally viewing dependent.

SUMMARY OF THE INVENTION

During the printing process, UV curable ink must be cured within a short time period after it has been deposited on the substrate, otherwise ink with positive dot gain may spread out and flow, or ink with negative dot gain may ball up. UV radiation sources mounted on the carriage are capable of emitting radiation at high enough energies to cure the ink within such time frames. However, a significant amount of power must be supplied to the UV radiation source to enable it to emit these high energies. Typical UV radiation sources are quite inefficient because most of the emitted radiation is unusable. A substantial percentage of the emitted radiation is not used because the source emits radiation with wavelengths over a spectrum which is much wider than the usable spectrum. In addition, to ensure that the required amount of radiation is transmitted to the ink, the carriage must scan across the substrate at moderate speeds, even though the print heads are capable of depositing ink onto the substrate at much higher carriage speeds.

It is desirable, therefore, to set or pre-cure the ink rather than fully cure it as the ink is deposited on the substrate so that the ink does not spread or ball up, even though it is still in a quasi-fluid state, i.e. the ink is not completely hardened. Such an arrangement requires less power, and, therefore, facilitates using smaller UV radiation sources. In addition, a lower energy output requirement would allow the carriage to operate at a higher speed. Hence, images can be printed at a higher rate, resulting in a higher throughput.

Embodiments of the invention implement an apparatus and method for setting radiation curable ink deposited on a substrate. Specifically, in one aspect of the invention, an ink jet printing system includes a UV energy source which emits UV radiation to polymerize or pin a fluid that is deposited onto a substrate by one or more ink jet print heads. The fluid can be an ink that is UV curable, or the fluid can be any other type of polymerizable fluid that does not necessarily contain a dye or pigment.

An embodiment of the invention uses controlled pinning energy to adjust the amount of ink interaction between drops, substrate, and ink layers, resulting in virtual elimination of gloss banding and control of the finished gloss level from a gloss level of approximately 85 to a gloss level of approximately 5. This is a significant feature in UV ink jet printing, i.e. to be able to control gloss within the printing system.

The invention thus provides a significant improvement in the technology of setting (aka pinning) and curing UV ink. That is, by controlling the pinning energy, the amount of drop to drop interaction can be controlled in a way that allows the finished gloss or matt content of the final image to be controlled. An added benefit of this gloss control is that a well known artifact of gloss banding or differential gloss banding is significantly reduced.

DETAILED DESCRIPTION OF THE INVENTION

The invention provides a significant improvement in the technology of setting (aka pinning) and curing UV ink. That is, by controlling the pinning energy, the amount of drop to drop interaction can be controlled in a way that allows the finished gloss or matt content of the final image to be controlled. An added benefit of this gloss control is that a well known artifact of gloss banding or differential gloss banding is significantly reduced.

Mills, et al., Radiation treatment for ink jet fluids, U.S. Pat. No. 7,600,867 (Oct. 13, 2009) (incorporated herein in its entirety by this reference thereto) discloses an apparatus and method for setting radiation curable ink deposited on a substrate. Specifically, in one aspect thereof, an ink jet printing system includes a UV energy source which emits pulsed UV radiation to polymerize a fluid that is deposited onto a substrate by one or more ink jet print heads. In some cases, the radiation emitted by the energy source is adjustable. The energy source emits low energy UV radiation to set the fluid, as well as a higher energy UV radiation to cure the fluid. In certain cases, the fluid is first set and subsequently cured. Thus, it is known to use different levels of energy to set the fluid and to cure the fluid via a common radiation source, but not to control pinning to influence the finished gloss or matte content of a final image.

In contrast thereto, embodiments of the invention herein manage ink jet drop interactions (gloss) by the control of pinning energy. Previously, pinning was used to prevent ink jet drop interactions with application of a low UV energy. A presently preferred embodiment of the invention allows control of UV ink drop interactions by adjusting the amount of pinning energy applied. References herein to pinning or setting are to freezing or gelling the ink to prevent interaction.

Figure 1:
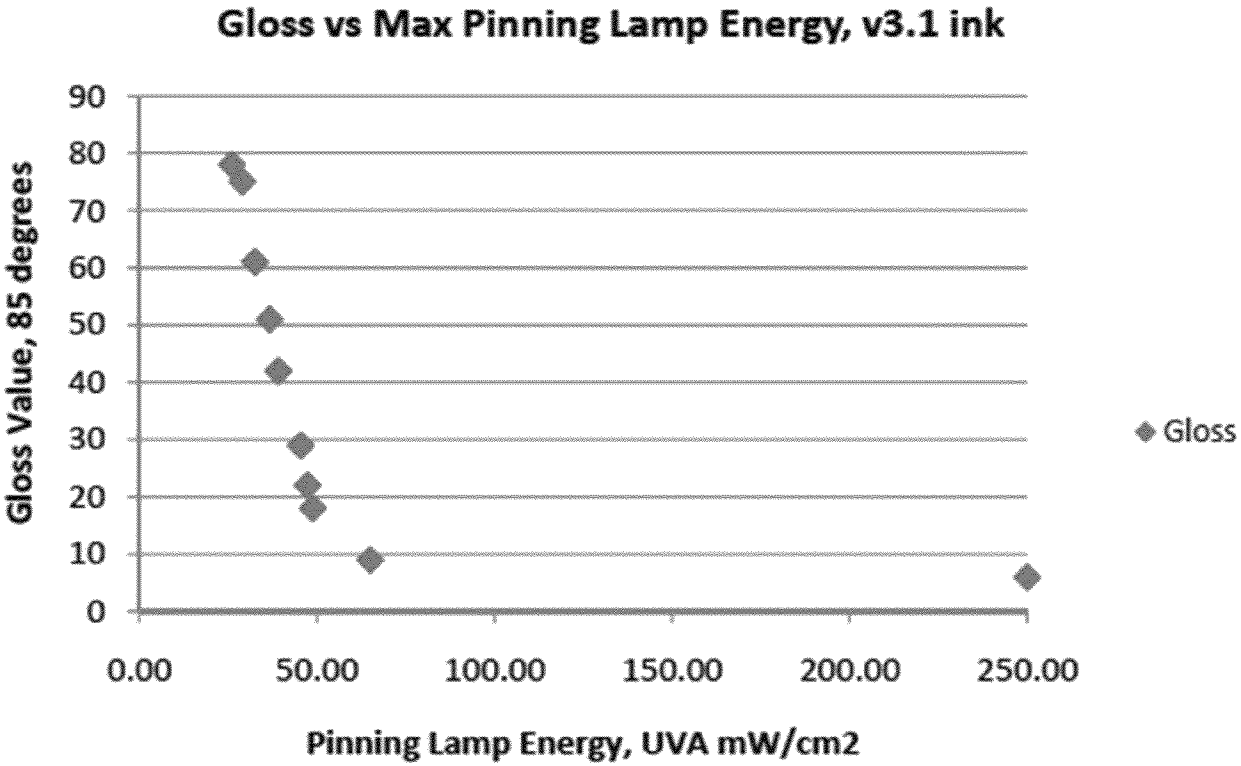
FIG. 1 is a graph that shows gloss vs. maximum printing lamp energy for a proprietary ink (v3.1 ink)

FIG. 1 is a graph that shows gloss vs. maximum printing lamp energy for a proprietary ink (v3.1 ink). As shown in FIG. 1, this corresponds to the intensity levels above 50 mW/cm2. The zone of control of drop interaction is below 50 mW/cm2. It can be seen from FIG. 1 that there is a direct relationship between gloss value and pinning lamp energy. The inventors have discovered and herein teach a technique that exploits this relationship to control gloss in UV inkjet printing. For purposes of the disclosure herein, the instrument used for measuring gloss is a BYK-Gardner micro-TRI-gloss meter, Catalog number 4446 sold by BYK-Gardner USA, Rivers Park II, 9104 Guilford Road, Columbia Md. 21046-2729. The gloss is measured at 85 degree angle. The instrument is capable of measuring at 20, 60, and 85 degree angles and is in conformity with DIN 67530, ISO 2813, and ASTM D-523, which define methods of measuring specular gloss. Those skilled in the art will appreciate that other instruments may be used to measure gloss in connection with practice of the invention disclosed herein.

Figure 2:
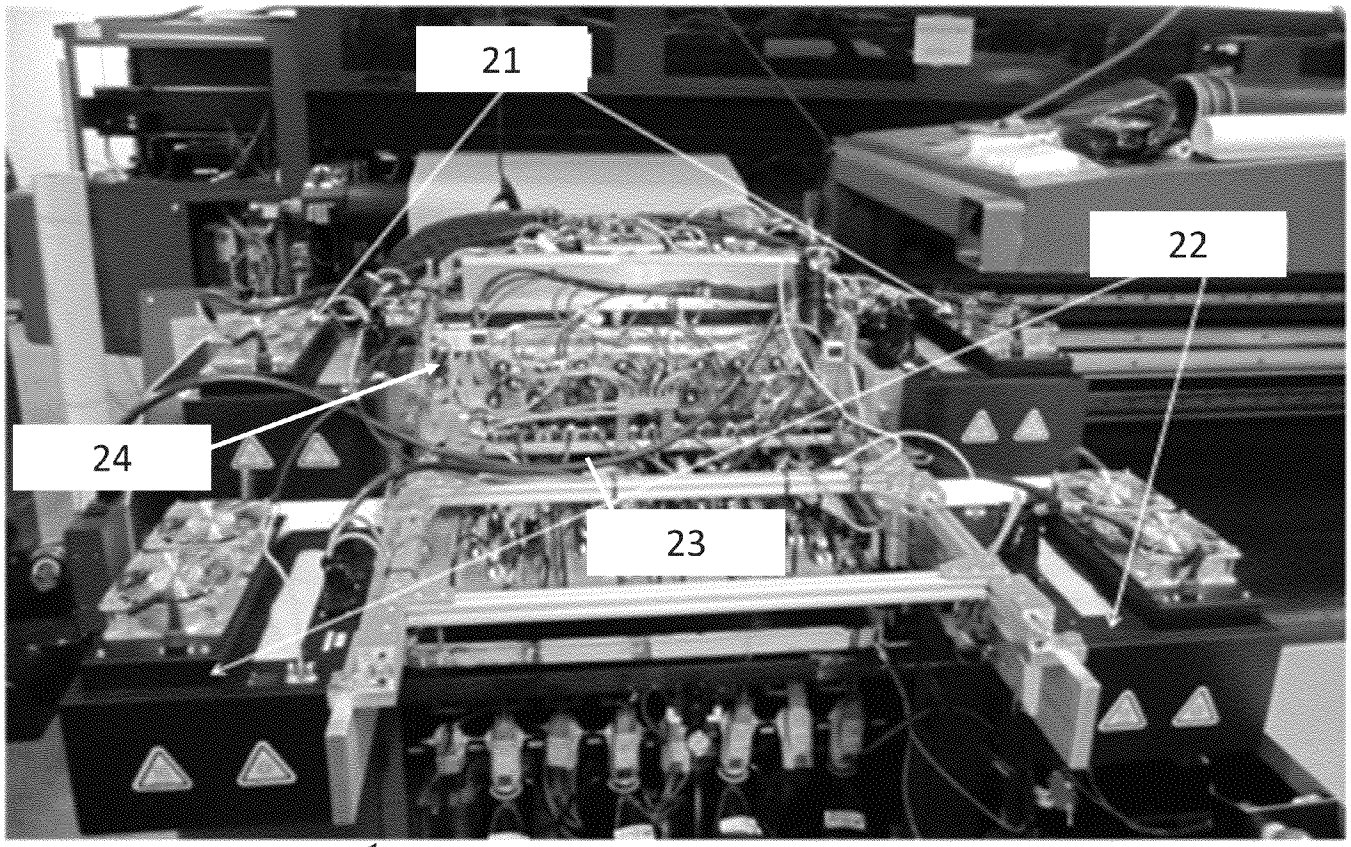
FIG. 2 is a perspective view of a printer the includes pinning lamps for use in connection with the invention herein disclosed.

FIG. 2 is a perspective view of a printer that includes pinning lamps for use in connection with the invention herein disclosed. An exemplary printer 20 is adapted for printing images on a variety of substrates. Typical substrates are polyvinyl chloride (PVC) and reinforced vinyl which can be provided with peal-off backings to expose pressure sensitive adhesive. The printer is able to print on flexible as well as on non-flexible substrates, for example, metals, glass, and plastics. The inks deposited on the substrate are UV curable. That is, the inks contain binders and colorants, as well as photoinitiators and surfactants. The surfactants are present in the ink to ensure that the ink is stable when in the liquid state. The binder generally consists of a blend of monomers and oligimers, and the photoinitiators are used to catalyze the polymerization reaction during which the monomers and/or oligimers are joined together to be become a polymeric binder. The polymerization generally occurs through a free-radical reaction process. When the energy from a UV source contacts the photoinitiator, the photoinitiator breaks a double bond in the monomers and/or oligimers. This produces new molecules that are free radicals which link together with other free radicals until the long chain polymer undergoes a termination reaction, or the free radicals are depleted. At this point, the binder is now a solid film of polymers that hold the colorant, which consists of pigments and/or dyes, to the substrate.

A typical printer includes the following components (not shown) a base, a transport belt which moves the substrate through the printing system, and a rail system attached to the base. A carriage 24 is coupled to the rail system. The carriage holds a series of inkjet print heads and one or more radiation sources, such as UV radiation sources, and is attached to a belt which wraps around a pair of pulleys positioned on either end of the rail system. A carriage motor is coupled to one of the pulleys and rotates the pulley during the printing process. As such, when the carriage motor causes the pulley to rotate, the carriage moves linearly back and forth along the rail system.

In FIG. 2, the printer 20 includes an array of print heads 23 and UV radiation sources, i.e. pin lamps 21 and cure lamps 22. In a presently preferred embodiment of the invention, separate pin lamps and cure lamps are used, although this arrangement is not necessary to practice the invention. This is explained in more detail in connection with the discussion of FIG. 3, below. In some embodiments, a single source of UV radiation emits such UV radiation to effect pinning and to polymerize the printing fluid deposited onto the substrate by the plurality of ink jet print heads to cure said printing fluid. In some embodiments, this single source is an LED array comprising a plurality of lamps, in which each of said lamps is modulated to a low, controlled, energy level to immobilize (pin) the printing fluid on the substrate when the lamp is a trailing lamp relative to an advancing edge of the substrate, and in which each of the lamps is modulated at an increased energy level to cure the printing fluid on the substrate when the lamp becomes a leading lamp relative to the advancing edge of the substrate.

The print heads and the UV radiation sources are mounted to the carriage. The UV radiation sources are attached to and positioned on either side of a carriage frame. A series of drop on demand inkjet print heads 23 is also mounted on the carriage frame and positioned between the UV radiation sources. In an embodiment, the series of inkjet print heads includes a set of black (K) print heads, a set of yellow (Y) print heads, a set of magenta (M) print heads, and a set of cyan (C) print heads. Each set of print heads is positioned on either side of an axis that is substantially orthogonal to an axis along which the carriage traverses. In an embodiment, the print heads are arranged so that during the printing process the black print heads first deposit black ink, then the yellow print heads deposit yellow colored ink, followed by the deposition of magenta ink from the magenta print heads, and finally the cyan print heads deposit cyan colored ink. These colors alone and in combination are used to create a desired image on a substrate. Thus, the image is made of regions having no ink or one to four layers of ink. For example, a green region of the image is produced by depositing two layers of ink, namely, yellow and cyan. And an intense black region of the image results from dispensing all four colors, cyan, magenta, yellow, and black. As such, this intense black region is made of four layers of ink.

Although certain regions of the image are made with multiple layers of ink, and all four sets of the print heads may simultaneously deposit ink onto the substrate, only one layer of ink is deposited at a given time on the portion of the substrate that is positioned beneath a respective set of print heads as the carriage scans across the substrate. As the ink is applied to the substrate, embodiments of the invention apply selected amounts of energy at selected times for selected intervals to the pin lamps to pin the ink to prevent gloss. The cure lamps are used to effect ink cure and the use of both the pin lamps and cure lamps may be coordinated to optimize print quality.

Figure 3:
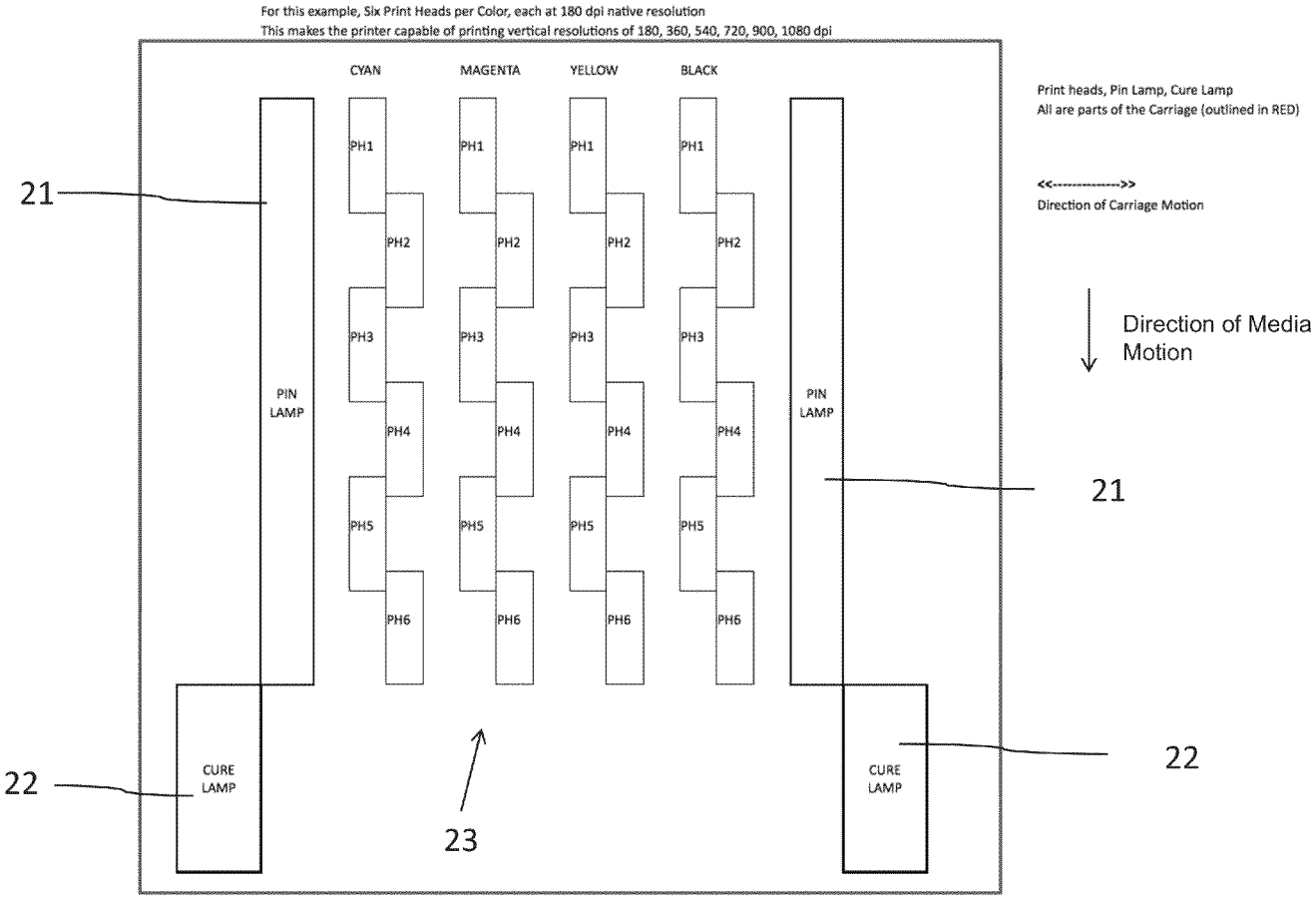
FIG. 3 is a block schematic representation of the printer shown in FIG. 2.

FIG. 3 is a block schematic representation of the printer 20 shown in FIG. 2. In FIG. 3, the array of print head 23 is fixed to a carriage (not shown). In the embodiment shown in FIG. 3, six print heads are provided for each color in a CMYK printing scheme, where each print head has a native 180 dpi resolution. This means that the exemplary printer of FIG. 3 is operable at resolutions of 180, 360, 540, 720, 900, and 1080 dpi. Those skilled in the art will appreciate that the invention may be practiced with any desired arrangement of print heads at any chosen resolution.

An arrow on FIG. 3 indicates the direction of carriage motion (Direction of Carriage Motion). The media on which ink is deposited is moved past the array of print heads, as indicated by another arrow on FIG. 3 (Direction of Media Motion). As can be seen, the media first passes the pinning lamps 21 and then progresses to the curing lamps 22. Those skilled in the art will appreciate that the actual arrangement of pinning lamps and curing lamps is a function of printer design and other factors. Variations in this arrangement are considered to be within the scope of the invention herein. For example, the curing lamps may be integrated with the pinning lamps; the pinning and curing lamps may be placed to the side of the media and/or above the media; etc. However, the presently preferred embodiment places the pinning lamps alongside the print heads to stabilize the ink drops immediately upon deposition onto the substrate; the curing lamps are placed at the end of the print head array that the substrate passes after ink deposition. Thus, in this embodiment, the time of travel for the substrate is a factor that is mitigated by lamp placement. That is, the pinning lamps stabilize the ink drops upon deposition, while the substrate is still being moved past the print head array, and the curing lamps freeze the ink drops after ink deposition is complete for any portion of the substrate. Further, the use of separate pinning lamps and cure lamps allows different types of lamps to be used for each function, thus optimizing the lamp to the function.

Exemplary Parameters

The following discussion and accompanying tables and figures provide exemplary parameters for use in practicing one or more embodiments of the invention. These parameters are not intended to limit the scope of the invention.

In an exemplary embodiment of the invention, the lamps and dosages listed below in Table 1 can be used for pinning. Circuitry for operation of such lamps is known, for example, from Mills, et al., Radiation treatment for ink jet fluids, U.S. Pat. No. 7,600,867 (Oct. 13, 2009) (incorporated herein in its entirety by this reference thereto).

TABLE 1

LED Pinning Lamp comparison

| Vendor | Model | Manufacturer Irradience mW/cm2 | Total Dosage at 60 ips mJ/cm2/ pass | UVA Irradience mW/cm2 | UVA Dosage at 60 ips mJ/cm2/ pass | cure width cm | UVA Dosage per mode, mJ NS | UVA Dosage per mode, mJ HS |
|---|---|---|---|---|---|---|---|---|
| Integration Tech* | PinCure | 500 | 3 | 38 | 0.2 | 0.4 | 0.8 | 1.5 |
| | PinCure Plus | 1000 | 5 | 76 | 0.4 | 0.4 | 1.5 | 3.0 |
| | LED Zero Vtwin Plus | 1500 | 17 | 115 | 1.3 | 0.9 | 5.2 | 10.4 |
| Phoseon** | StarFire | 2000 | 50 | 76 | 1.9 | 2 | 7.6 | 15.2 |
| | Phoseon on Beta 5 | 1000 | 25 | 38 | 1.0 | 2 | 3.8 | 7.6 |

*Integration Technology, 115 Heyford Park, Upper Heyford, Oxon OX25 5HA, England

**Phoseon Technology, 7425 NW Evergreen Parkway, Hillsboro, OR 97124

Figure 4:
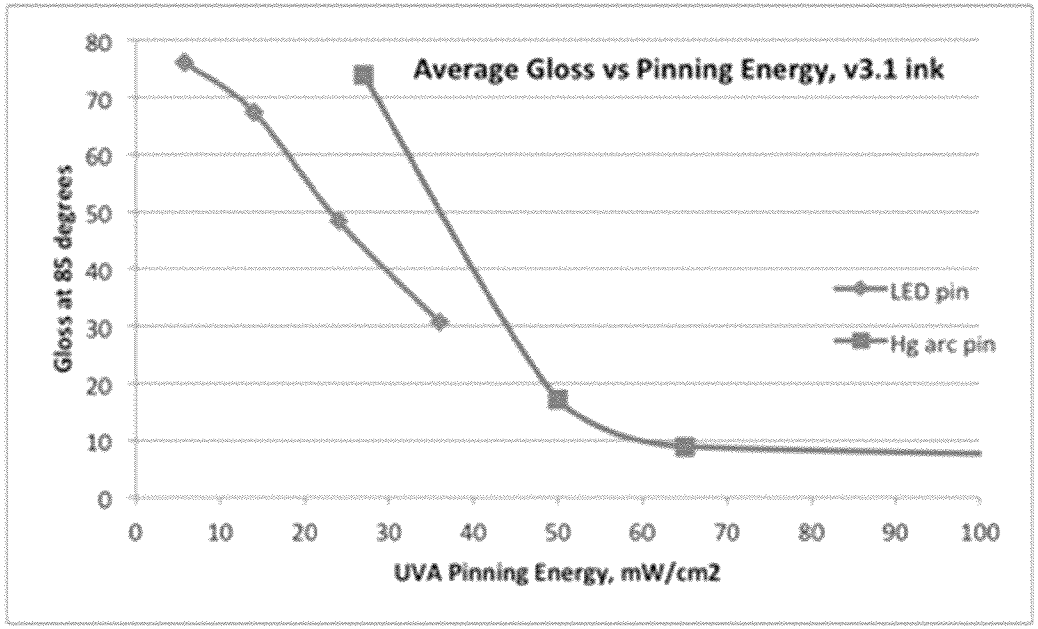
FIG. 4 is a graph that shows average gloss vs. pinning energy for v3.1 ink.

FIG. 4 is a graph that shows average gloss vs. pinning energy for v3.1 ink, showing plot lines for LED pinning lamps and Hg arc pinning lamps. While the invention is discussed herein in connection with LED pinning lamps and Hg arc pinning lamps, those skilled in the art will appreciate that the invention is readily practiced with other lamps and heat sources.

FIG. 4 shows the effect of controlling gloss by adjusting pinning energy. See, also, Table 1 below. Unlike the state of the art, embodiments of the invention control the amount of energy supplied to the pinning lamps and, thus control the amount of ink interaction. Accordingly, as contrasted to merely using lamps to freeze the ink dots, the invention provides a technique that controls their interaction. This approach slows the growth of each ink dot applied to the media rather than freezing it. It is therefore possible to slow down the rate of such ink dot growth or spread at different rates by applying different amounts of energy to the pinning lamps in a specific way.

For example, in some print jobs it may be desirable to allow some dot spread between the time the print head lays down an ink and the final cure. The energy profile is determined by such factors as, for example, the variables that control ink spread, the surface tension of the particular ink that is used, the mechanism that is used to vary the energy delivered to the pinning lamps, the color or the type of image, etc. Ink volume in any one location is one of the variables that controls ink spread. The ink itself could be different concentrations of photo initiator, which would change the rate of cure. Another variable is UV intensity. The wavelength of the UV is also a variable. Further, different formulations of inks have different characteristics. Factors that affect the ink include, for example, the ink formulation, the color, and the combinations of different inks with one another.

The presently preferred embodiment of the invention employs an initial adjustment that sets the energy supplied to the pinning lamps (and light output by the pinning lamps) to any one or more of the optimal wavelength, intensity, duration for any particular ink.

Another embodiment of the invention provides an adjustment associated with the printer that allows one to vary the amount of gloss. This adjustment can be a software controlled adjustment, such as would be made by user interaction with a computer or printer based GUI, or it may be a hardware adjustment, such as a control knob on the printer. The adjustment takes into account all factors that affect gloss, as discussed above, for a particular ink and medium. The control need not be infinitely variable, but can have preset selections, such as high gloss, medium gloss, low gloss, and matte finish. As set, the desired gloss (or lack therefor) is produced in accordance with the energy delivered to the pinning lamps. For example, if it is desired to print a job for a department store, then it may be desirable to have one sort of gloss and, if the print job is for another type of application, then it may be desirable for it to be very glossy or very matte.

For purposes of the discussion herein, various tables are provided below that provide a value for gloss. In these tables a value of 100 on the gloss level is perfectly smooth, almost like glass, and very highly reflective; and zero is substantially flat and reflects very little, if at all. A presently preferred embodiment controls energy to the pinning lamps to provide a flat image that looks fairly uniform. This alleviates some print artifacts. In this embodiment, the gloss levels are typically 10 to 15. Those skilled in the art will appreciate that gloss level is determined as desired for any particular application. This is a key advantage of the invention: one can control energy supplied to the pinning lamps to control gloss.

In some embodiments, it is possible to vary the intensity of the pinning lamps depending on the image content on a per page or per area basis. Thus, different pages or different areas of an image to be printed can have different levels of gloss. For example, text may be low gloss and an image may have a higher level of gloss.

In some embodiments, a change of ink type may require resetting of the variables that adjust the level of gloss. Typically, a printer is designed around a particular ink type. In an embodiment, the printer is sold with a specific ink type. In some embodiments, a replacement ink or different type of ink includes either new printer software, instructions for making new settings on the printer, or new pinning lamps that match the ink. In some embodiments, the user can patch printer driver software with the new optimization levels. This approach allows a variety of ink types to be used on a printer, as long as the lamps are capable of pinning and curing the ink at the right wavelengths and energy levels.

In some embodiments, the foregoing techniques increase the printer throughput because, while the state of the art freezes ink dots immediately when they are applied to the media, the invention allows one to control the rate at which the ink is cured, allowing the media to be moved more quickly during the curing process, thus producing a better image quality at the higher speeds. Further, because the approach herein controls the ink drop interaction, it is possible to print with less interlacing and get a better result. It is difficult to do this with the Hg arc lamps without repositioning them. It is possible to get more control of the individual LEDs, and in some embodiments it is possible to reposition the lamps to change how the pinning is applied to the print.

Pinning Energy vs. Gloss

Table 2 below shows pin energy vs. gloss. From Table 2 and FIG. 4 (discussed above) it can be seen that pin energy can be applied at any point along a continuum to produce a profile that provides a desired degree of (or lack of) gloss. Further, while a value of 85 degrees is shown, those skilled in the art will appreciate that the invention may be practiced with other values.

TABLE 2

Pin Energy vs. Gloss

| | Gloss at 85 degrees | |
|---|---|---|
| Pin Energy mW/cm2 | LED pin | Hg arc pin |
| 5.8 | 76.2 | |
| 14 | 67.3 | |
| 24 | 48.3 | |
| 36 | 30.7 | |
| 27 | | 73.8 |
| 50 | | 17.2 |
| 65 | | 8.9 |
| 250 | | 5.5 |

Figure 5:
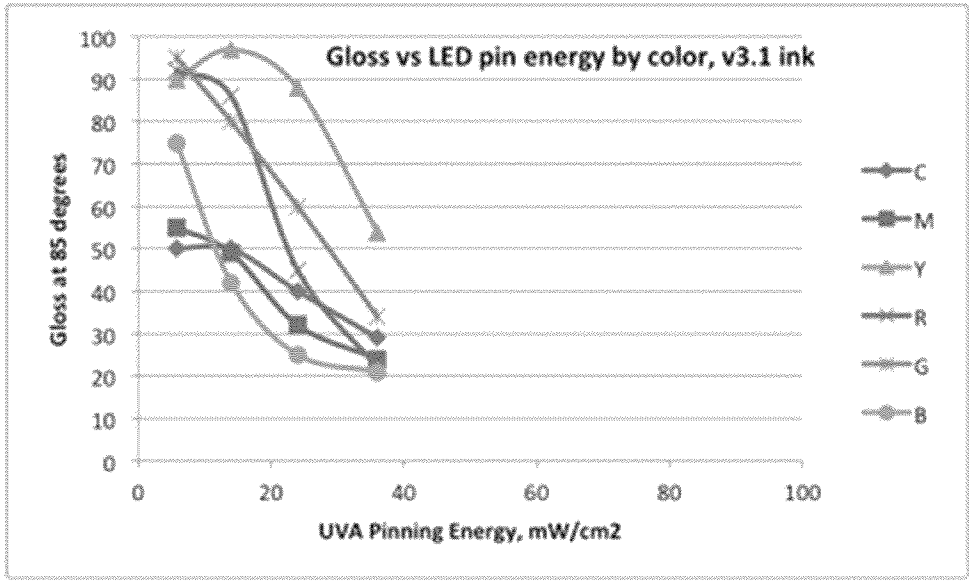
FIG. 5 is a graph that shows gloss vs. LED pin energy by color for v3.1 ink.
Figure 6:
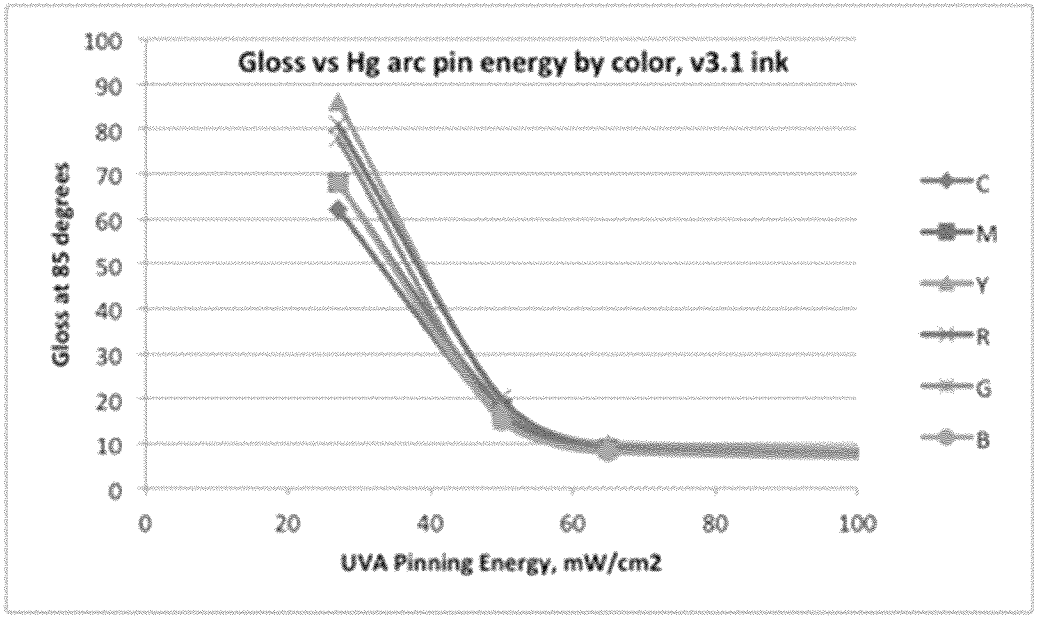
FIG. 6 is a graph that shows gloss vs. Hg arc pin energy by color for v3.1 ink.

FIG. 5 is a graph that shows gloss vs. LED pin energy by color for v3.1 ink; and FIG. 6 is a graph that shows gloss vs. Hg arc pin energy by color for v3.1 ink. Table 3 below (see, also, FIG. 5) shows double cure lamps at 60%, LED pinning unidirectional; and Table 4 below (see, also, FIG. 6) shows Hg arc lamps for pinning (GS Lamp shade type), both with heavy smoothing.

TABLE 3

| Gloss Measurements, LED pinning | | | | | | | |
|---|---|---|---|---|---|---|---|
| mW/cm2 | C | M | Y | R | G | B | Average |
| 5.8 | 50 | 55 | 90 | 92 | 95 | 75 | 76.2 |
| 14 | 50 | 49 | 97 | 86 | 80 | 42 | 67.3 |
| 24 | 40 | 32 | 88 | 45 | 60 | 25 | 48.3 |
| 36 | 29 | 24 | 54 | 22 | 34 | 21 | 30.7 |

TABLE 4

| Gloss Measurement Hg, Arc Pinning | | | | | | | |
|---|---|---|---|---|---|---|---|
| mW/cm2 | C | M | Y | R | G | B | Average |
| 27 | 62 | 68 | 86 | 81 | 78 | 68 | 73.8 |
| 50 | 16 | 18 | 19 | 20 | 15 | 15 | 17.2 |
| 65 | 9 | 8.8 | 10 | 9 | 8.5 | 8 | 8.9 |
| 250 | 6 | 5.7 | 6.5 | 4.8 | 5 | 5 | 5.5 |

Pinning Vs. Ink and Wavelength

Figure 7:
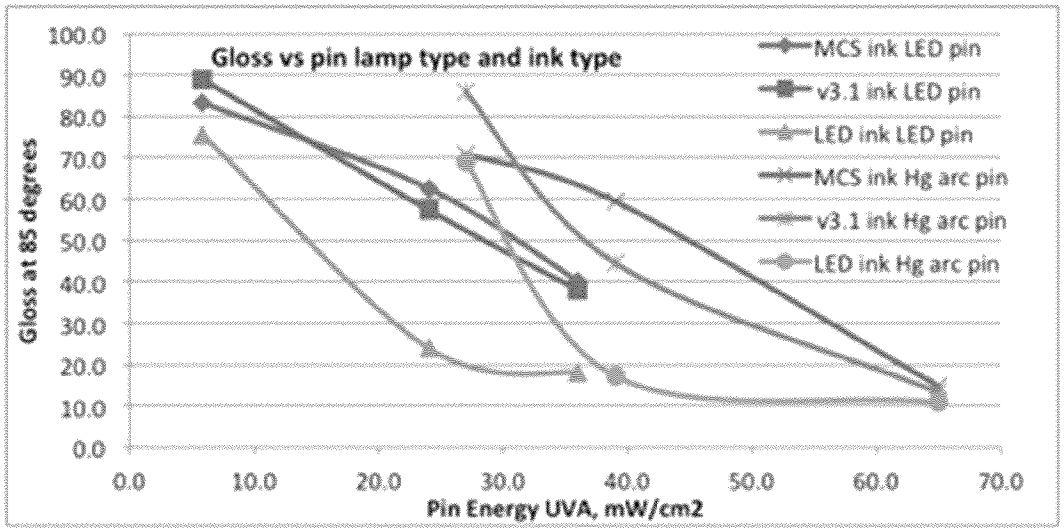
FIG. 7 is a graph that shows gloss vs. pin lamp type and ink type.

FIG. 7 is a graph that shows gloss vs. pin lamp type and ink type. Table 5 below shows gloss measurements at 85 degrees for three different inks and two different pinning wavelengths.

TABLE 5

| Gloss Measurements at 85 Degrees for Three Different Inks and Two Different Pinning Wavelengths | | | | | | | | | |
|---|---|---|---|---|---|---|---|---|---|
| Ink Type | Pinning Lamps | UVA mW/cm2 | C | M | Y | R | G | B | Avg |
| MCS | Hg | 27 | 95.1 | 96.3 | 94.1 | 39.5 | 8.5 | 91.2 | 70.8 |
| MCS | Hg | 39 | 58.3 | 71.3 | 64.8 | 58.2 | 28.1 | 75.8 | 59.4 |
| MCS | Hg | 65 | 15.3 | 18.2 | 15.2 | 13.7 | 10.4 | 15.4 | 14.7 |
| MCS | LED | 5.8 | 91.5 | 98.4 | 97.2 | 63.9 | 57.7 | 91.4 | 83.4 |
| MCS | LED | 24 | 50.7 | 55.8 | 97.3 | 62.4 | 41.4 | 67.4 | 62.5 |
| MCS | LED | 36 | 30.9 | 29.0 | 73.3 | 35.5 | 42.0 | 30.1 | 40.1 |
| 3.1 | Hg | 27 | 79.1 | 72.3 | 91.4 | 89.4 | 94.6 | 88.1 | 85.8 |
| 3.1 | Hg | 39 | 35.5 | 36.1 | 46.1 | 49.8 | 49.3 | 49.9 | 44.5 |
| 3.1 | Hg | 65 | 13.9 | 14.0 | 15.2 | 11.7 | 12.0 | 12.5 | 13.2 |
| 3.1 | LED | 5.8 | 68.6 | 76.4 | 99.4 | 94.7 | 97.6 | 97.1 | 89.0 |
| 3.1 | LED | 24 | 43.6 | 37.8 | 98.6 | 55.3 | 72.5 | 36.1 | 57.3 |
| 3.1 | LED | 36 | 34.8 | 30.7 | 66.8 | 32.9 | 36.7 | 25.9 | 38.0 |
| LED | Hg | 27 | 79.9 | 61.2 | 62.9 | 74.0 | 47.5 | 87.7 | 68.8 |
| LED | Hg | 39 | 21.2 | 18.1 | 16.2 | 14.2 | 14.9 | 18.2 | 17.2 |
| LED | Hg | 65 | 12.5 | 12.2 | 11.3 | 9.6 | 9.2 | 10.6 | 10.9 |
| LED | LED | 5.8 | 76.1 | 66.4 | 96.0 | 63.3 | 76.1 | 74.7 | 75.4 |
| LED | LED | 24 | 33.4 | 19.0 | 19.1 | 24.3 | 26.3 | 21.4 | 23.9 |
| LED | LED | 36 | 20.9 | 17.1 | 15.0 | 18.8 | 18.7 | 17.5 | 18.0 |

Figure 8:
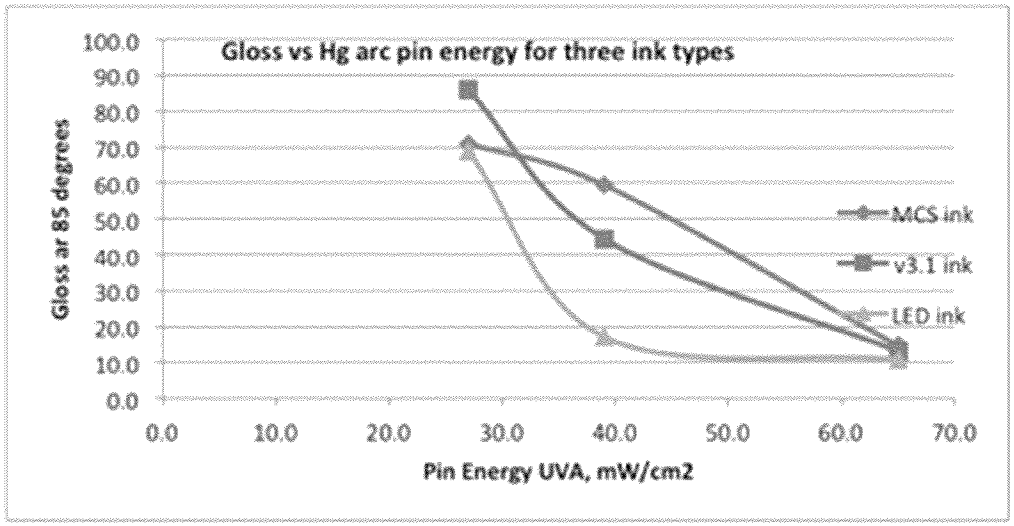
FIG. 8 is a graph that shows gloss vs. Hg arc energy for three ink types.

FIG. 8 is a graph that shows gloss vs. Hg arc energy for three ink types. Table 6 below also shows gloss vs. Hg arc energy for three ink types.

TABLE 6

| Hg Arc Pin Lamp | | | |
|---|---|---|---|
| mW/cm2 | MCS ink | v3.1 ink | LED ink |
| 27.0 | 70.8 | | |
| 39.0 | 59.4 | 44.5 | 17.2 |
| 65.0 | 14.7 | 13.2 | 10.9 |

Figure 9:
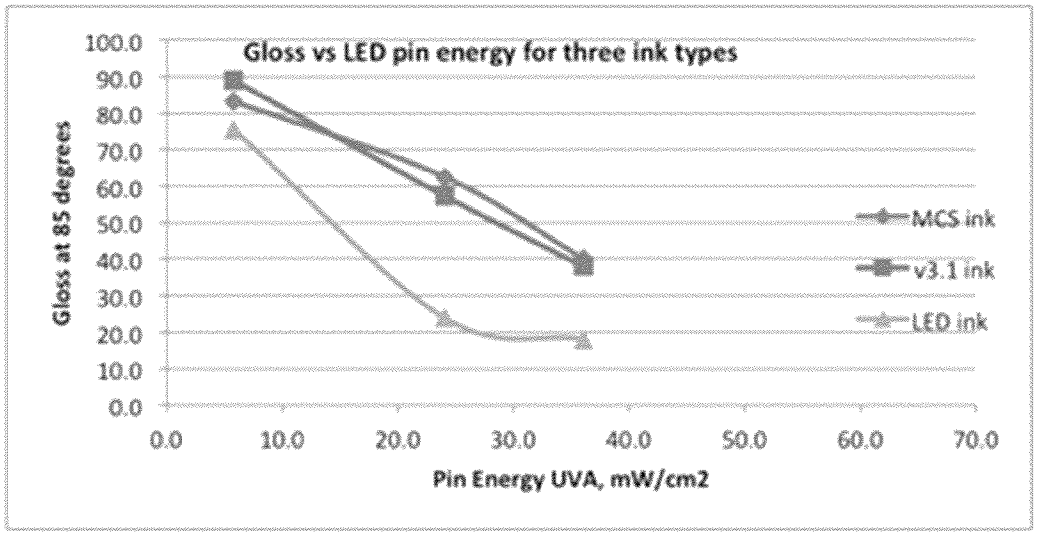
FIG. 9 is a graph that shows gloss vs. LED energy for three ink types.

FIG. 9 is a graph that shows gloss vs. LED energy for three ink types. Table 7 below also shows gloss vs. LED energy for three ink types.

TABLE 7

| LED Pin Lamp | | | |
|---|---|---|---|
| mW/cm2 | MCS ink | v3.1 ink | LED ink |
| 5.8 | 83.4 | 89.0 | 75.4 |
| 24.0 | 62.5 | 57.3 | 23.9 |
| 36.0 | 40.1 | 38.0 | 18.0 |

Table 8 below shows gloss vs. pin lamp type and ink type.

TABLE 8

| Gloss vs. Pin Lamp Type and Ink Type | | | | | | |
|---|---|---|---|---|---|---|
| mW/cm2 | MCS ink, LED pin | v3.1 ink, LED pin | LED ink, LED pin | MCS ink, Hg arc pin | v3.1 ink, Hg arc pin | LED ink, Hg arc pin |
| 5.8 | 83.4 | 89.0 | 75.4 | | | |
| 24.0 | 62.5 | 57.3 | 23.9 | | | |
| 36.0 | 40.1 | 38.0 | 18.0 | | | |
| 27.0 | | | | 70.8 | 85.8 | 68.8 |
| 39.0 | | | | 59.4 | 44.5 | 17.2 |
| 65.0 | | | | 14.7 | 13.2 | 10.9 |

Table 9 (below) shows the intensity of the pinning lamp at various levels of energy and the level of gloss for each level of energy relative to a specific test print. In this case of Table 9, the pinning lamp is an LED. As can be seen from Table 9, a high energy pin produces a certain amount or lack of gloss, as measured with a gloss meter.

TABLE 9

| Beta 5 Phoseon Starfire 2 × 12" pinning, HS versus inks | | | | | | |
|---|---|---|---|---|---|---|
| | | | | | "Red" Gloss measurement | |
| Mode | # lamp pass | carr ips | est mW/cm2 | est mJ | LX LED ink | v3.1 |
| Uni HS 1x Starf | 16 | 63 | 0 | 0.0 | 94 | |
| Uni HS 1x Starf | 16 | 63 | 3.2 | 0.6 | 86 | |
| Uni HS 1x Starf | 16 | 63 | 5.8 | 1.2 | 63 | 94.7 |
| Uni HS 1x Starf | 16 | 63 | 8.4 | 1.7 | 49 | |
| Uni HS 1x Starf | 16 | 63 | 13.8 | 2.8 | 37 | |
| Uni HS 1x Starf | 16 | 63 | 18.1 | 3.6 | 34 | |
| Uni HS 1x Starf | 16 | 63 | 24 | 4.8 | 24.3 | 55.3 |
| Uni HS 1x Starf | 16 | 63 | 28.8 | 5.8 | 28 | |
| Uni HS 1x Starf | 16 | 63 | 33.2 | 6.6 | 27.7 | |
| Uni HS 1x Starf | 16 | 63 | 36 | 7.2 | 19 | 33 |

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A printing system comprising:

a print head array comprising a plurality of ink jet print heads for depositing a printing fluid onto a substrate to form images on the substrate; and a first source which emits UV radiation to polymerize the printing fluid deposited onto the substrate by the plurality of ink jet print heads sufficiently to immobilize, but not cure, said printing fluid;

a mechanism for adjusting an energy level of the radiation emitted by said first source, wherein the fluid is selectively immobilized by said first source to exhibit a desired degree, or lack, of gloss;

wherein the energy level shown in the "Pin Energy" column of the following table results in the corresponding exhibited gloss levels in the "Gloss at 85 degrees" column of the table:

| | Gloss at 85 degrees | |
|---|---|---|
| Pin Energy mW/cm2 | LED pin | Hg arc pin |
| 5.8 | 76.2 | |
| 14 | 67.3 | |
| 24 | 48.3 | |
| 36 | 30.7 | |
| 27 | | 73.8 |
| 50 | | 17.2 |
| 65 | | 8.9 |
| 250 | | 5.5. |

2. The system of claim 1, wherein said first source is positioned proximate to said print head array.

3. The system of claim 1, wherein said first source emits UV radiation to polymerize the printing fluid deposited onto the substrate by the plurality of ink jet print heads to cure said printing fluid.

4. The system of claim 3, said first source comprising an LED array comprising a plurality of lamps, wherein each of said lamps is modulated to a low, controlled, energy level to immobilize said printing fluid on said substrate when said lamp is a trailing lamp relative to an advancing edge of the substrate and wherein each of said lamps is modulated at an increased energy level to cure said printing fluid on said substrate when said lamp becomes a leading lamp relative to said advancing edge of the substrate.

5. The system of claim 1, further comprising:

a second source, positioned away from said print head array along an axis of substrate travel, which emits UV radiation to polymerize the printing fluid deposited onto the substrate by the plurality of ink jet print heads to cure said printing fluid.

6. The system of claim 1, wherein the energy level is adjustable between a low level to set the fluid to exhibit a high degree of gloss and a higher level to set the fluid to exhibit a lower degree of gloss.

7. The system of claim 1, wherein the fluid is an ink.

8. The system of claim 1, wherein said first source comprises one or more UV lamps.

9. The system of claim 1, wherein said first source comprises one or more LEDs.

10. The system of claim 1, said first source comprises one or more Hg arc lamps.

11. The system of claim 1, wherein the print head array comprises a carriage which scans in a direction substantially orthogonal to the direction of movement of the substrate.

12. The system of claim 11, wherein the carriage is constructed to move bidirectionally.

13. The system of claim 12, wherein the first source is moveable relative to the carriage in a direction substantially parallel to the direction of movement of the substrate.

14. The system of claim 1, wherein the first source comprises a pair of lamps mounted to a carriage of the printing system, the carriage being coupled to a rail system so that the carriage moves along the rail system to scan across the substrate.

15. A printing system comprising:

a print head array comprising a plurality of ink jet print heads for depositing a printing fluid onto a substrate to form images on the substrate; and a source which emits UV radiation to polymerize the printing fluid deposited onto the substrate by the plurality of ink jet print heads;

wherein the fluid is first immobilized and subsequently cured;

wherein the source comprises a first UV source which immobilizes the liquid and a second UV energy source which cures the liquid, the first UV source being positioned adjacent to the print heads and the second UV source being positioned adjacent to a trailing side of the first UV energy source;

wherein an energy level of the radiation emitted by the first source is selectively adjustable to selectively immobilize the fluid with said first source to exhibit a desired degree, or lack, of gloss;

wherein the energy level shown in the "Pin Energy" column of the following table results in the corresponding exhibited gloss levels in the "Gloss at 85 degrees" column of the table:

| | Gloss at 85 degrees | |
|---|---|---|
| Pin Energy mW/cm2 | LED pin | Hg arc pin |
| 5.8 | 76.2 | |
| 14 | 67.3 | |
| 24 | 48.3 | |
| 36 | 30.7 | |
| 27 | | 73.8 |
| 50 | | 17.2 |
| 65 | | 8.9 |
| 250 | | 5.5. |

16. The system of claim 15, wherein an energy level of the radiation emitted by the first source is adjustable by varying the pulse rate of the first source.

17. The system of claim 15, wherein the fluid is an ink.

18. The system of claim 15, wherein the first source comprises one or more UV lamps.

19. The system of claim 18, wherein the first source comprises one or more LEDs.

20. The system of claim 18, wherein said first source comprises one or more Hg arc lamps.

21. The system of claim 18, wherein the lamps are moveable relative to the carriage.

22. The system of claim 18, wherein an energy level of the radiation emitted by the first source is adjustable between about 5.8 to about 36 mW/cm2 to produce a corresponding gloss level of about 76.2 to about 37 at 85 degrees.

23. The system of claim 20, wherein an energy level of the radiation emitted by the first source is adjustable between about 27 to about 250 mW/cm2 to produce a corresponding gloss level of about 73.8 to about 5.5 at 85 degrees.

24. The system of claim 15, wherein parameters, in addition to energy level of radiation emitted from the first source, that are selectively adjustable to selectively immobilize the fluid with said first source to exhibit a desired degree, or lack, of gloss comprise any of ink composition, lamp wavelength, interval of lamp illumination, length of lamp array, rate at which energy supplied to one or more lamps is increased, rate at which energy supplied to one or lamps is decreased, and selective operation of one or more lamps.

* * * * *